United States Patent [19]

Marzoli

[11] 4,279,119

[45] Jul. 21, 1981

[54] ROTARY RING FOR SPINNING AND TWISTING FRAME

[75] Inventor: Angelo Marzoli, Palazzolo Sull'Oglio, Italy

[73] Assignee: F. lli Marzoli & C. S.p.A., Italy

[21] Appl. No.: 58,993

[22] Filed: Jul. 19, 1979

[30] Foreign Application Priority Data

Jul. 25, 1978 [IT] Italy ..... 26077 A/78

[51] Int. Cl.[3] ..... D01H 7/56

[52] U.S. Cl. ..... 57/124; 57/122

[58] Field of Search ..... 57/119–124, 57/75, 113

[56] References Cited

U.S. PATENT DOCUMENTS

| | | | |
|---|---|---|---|
| 1,450,348 | 4/1923 | Beede | 57/113 |
| 2,541,238 | 2/1951 | Goree | 57/124 |
| 2,563,187 | 8/1951 | Pennati | 57/124 |
| 2,725,712 | 12/1955 | Rooney | 57/124 |
| 3,205,647 | 9/1965 | Matsui | 57/124 |
| 3,494,120 | 2/1970 | Chilpan et al. | 57/124 X |
| 4,095,402 | 6/1978 | Yamaguchi | 57/124 |
| 4,114,359 | 9/1978 | Creus | 57/124 |
| 4,150,531 | 4/1979 | Marzoli | 57/124 |

FOREIGN PATENT DOCUMENTS

| | | | |
|---|---|---|---|
| 26996 | of 1907 | United Kingdom | 57/124 |

*Primary Examiner*—John Petrakes
*Attorney, Agent, or Firm*—Karl W. Flocks

[57] ABSTRACT

In a spindle assembly of a spinning or twisting frame, the improvement consisting in inserting, between the stator and the rotor of the spindle assembly, braking members made of an antifriction material in the form of arcuate blocks or sectors which act also as spacers for the revolving members (usually spheres) which match the stator with the rotor.

The device solves the problem of providing a braking action for providing the thread tension without problems of overheating the thread being spun.

7 Claims, 20 Drawing Figures

15
16
17
10
19
11
18
V
V
14
24
25
26
12
27
13

12
24
11
14
16
15
13
25
24
14
24

ROTARY RING FOR SPINNING AND TWISTING FRAME

This invention relates to rotary rings intended to be installed on spinning and twisting frames in replacement for the conventional devices which are composed by a ring and a traveler running on the ring track.

It is known that, in the conventional spinning systems, the traveler dragged by the thread, runs on the ring track and provides the braking action which is required to impress the tension to such thread. Such a braking action is a function of the high specific pressure of the traveler on the ring and such pressure is strictly bound to the centrifugal force. This fact originates a considerable heating of the traveler and thus a rapid wear of same: in addition, heat sensitive threads can be processed only with difficulty.

An object of the present invention is to do away with the shortcomings indicated above, that is, to provide a rotary ring for a spinning and twisting frame which makes it possible:

- to obtain high speed increases for the spindles and thus high outputs, while concurrently providing the conditions of a ring speed which is slightly lower than that of the spindles;
- to dispense with the change of the traveler both as a function of the yarn count and the production speed;
- to process heat sensitive yarns;
- to spin the entire range of the yarn counts, from the lightest to the heaviest with a limited number of ring diameters.

In order that these problems may be solved, a ring has been envisaged, which comprises an annular stator body affixed to the ring rail, an annular rotor body which is rotatably matched, by means of revolving elements, to such a stator coaxially with the latter and with the relative machine spindle and the rotor aforesaid is fitted with a hook for passing therethrough the thread being processed which grads the hook to rotation and braking means inserted between the stator and the rotor, said ring being characterized in that the braking means aforesaid are component parts of the ring itself.

More particularly, the braking means consist of sectors in the form of segments of an annulus and which, under the bias of the centrifugal force acting thereupon frictionally engage the inside walls of the stator and delay, by a little, the speed of rotation of the rotor relative to the spindle speed.

These sectors can be mounted, with clearance, in seatings formed in an annular member resting on the stator bottom wall and which has the task of providing a spacing cage between the revolving members, or, as an alternative, the sectors may be mounted without any annular member interposed and in this case such sectors themselves are the spacing elements between the revolving members.

The sectors may have, or not, sealings in which the revolving members are housed.

In the case in which the sectors are not mounted in a cage, in order that the braking action may be improved and the inertia of the rotors may be reduced when the spindles are stopped, the sectors are brought to contact the stator inner walls by means of a split body which is introduced with a slight pressure into a groove formed through the inner surface of the sectors, and the annular body acts like a spring.

In addition the rotary members which compose the ring according to the present invention must act in such a way that the thread tension, on winding, must be slightly greater than the sum of the four frictional forces due to:

- the action of the centrifugal force acting upon the rotor, which is negligible as itself,
- the action of the centrifugal force acting upon the sectors,
- the action of the centrifugal force acting upon the revolving members, which is negligible as itself, and
- the action of the weight of the sectors and/or the cage, acting on the stator bottom wall, which is negligible as itself.

It should be noted that, in this invention, the rotor is not radially loaded by forces due to hooked-up members, but is dynamically balanced since the hook through which the thread is passed, must have the same weight as the material which has been removed to provide either the bore or the slot where the hook is applied: moreover, the component of the traction force of the thread further lightens the own weight of the hook.

A ring so constructed has the following advantageous features:

- it exploits a braking action which can automatically be adjusted as a function of the magnitude of the spindle speed, so that the rotor rotation speed is always slightly below the spindle spin;
- the traveler must not be changed in connection with the count of yarn and the output range;
- it generates the braking action with means which prevent the thread to contact high temperature areas so that heat-sensitive yarns can be processed at high speed without any hindrances;
- it makes it possible to spin the entire count range with a comparatively narrow range of ring diameters available.

The foregoing and other features and advantages of the invention will become clearly apparent from the ensuing description of a few exemplary embodiments indicated for illustration and without limitation in the accompanying drawings, wherein.

Figure 1:
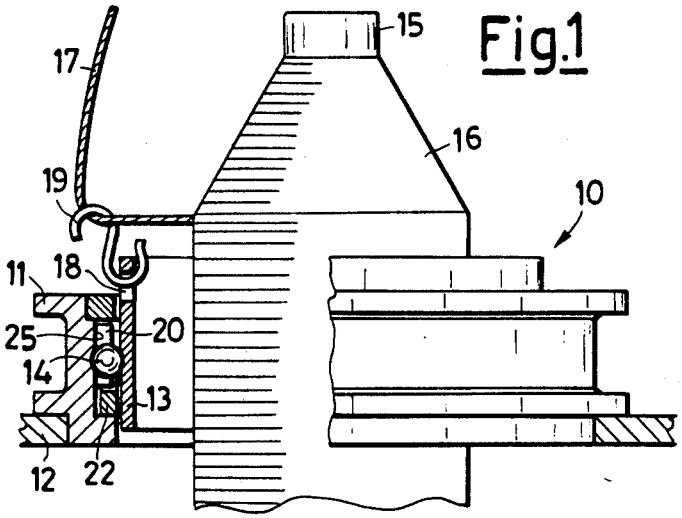
FIG. 1 shows, for one half in cross-section and for the other half in elevation, a rotary ring according to the invention, in which the sectors are mounted, with clearance, in seats formed in the case.
Figure 2:
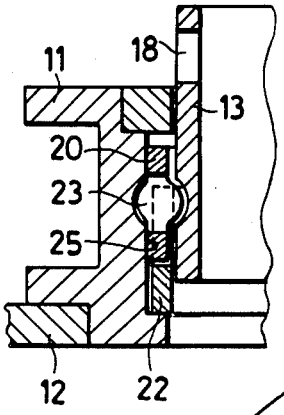
FIG. 2 shows a closeup view of the cross-section of FIG. 1.
Figure 3:
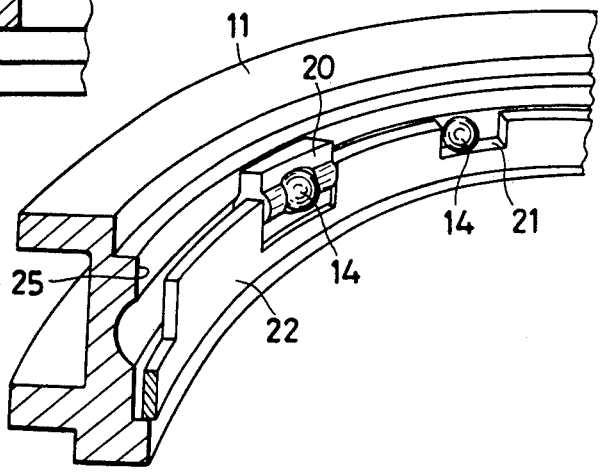
FIG. 3 is a perspective view of a fragmentary section of the cage incorporating a sector and the revolving menbers.

FIGS. 1, 2 and 3 show an embodiment of the rotary ring according to this invention, generally indicated at 10 and comprising an annular stator body 11, fastened to the ring rail 12 of a spinning frame, and an annular rotor body 13 concentrically and rotatably connected to the stator 11 by means of revolving members 14.

Centrally of the ring 10 and coaxially therewith there is located the spindle, on which the tube 15 is slipped for the formation of the thread bobbin 16.

The thread 17 to be wound on the tube 15 comes, quite conventionally, from a drawing frame and a thread-guide (not shown).

The rotor 13 of the ring has on its top a slot-like bore 18 to which the member 19 is hooked and the thread 17 is passed through the latter member.

It should be borne in mind that the weight of the material which has been removed to provide the slot-like bore 18 nearly equals to weight of the member 19.

In this illustrative example the braking means are blocks 20 made of an antifriction material and which are mounted with a clearance in seatings 21 formed through an annular member 22, and resting onto the bottom wall of the stator 11, member 22 having the function of spacer for the revolving members 14.

The blocks 20 may, or may not, have a bore 23 in which the revolving member 14 is housed with clearance.

Consistently with the braking action which is required, the blocks 20 can be one or a plurality so that the revolving members 14 are positioned in the seatings 21.

Figure 4:
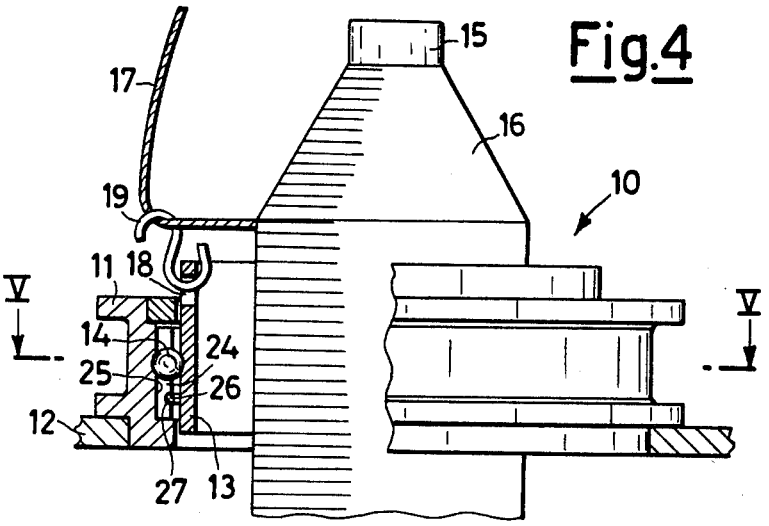
FIG. 4 shows, for one half in cross-section and for the other half in elevation, a rotary ring according to the invention, in which the sectors act as spacing members between the revolving members.
Figure 5:
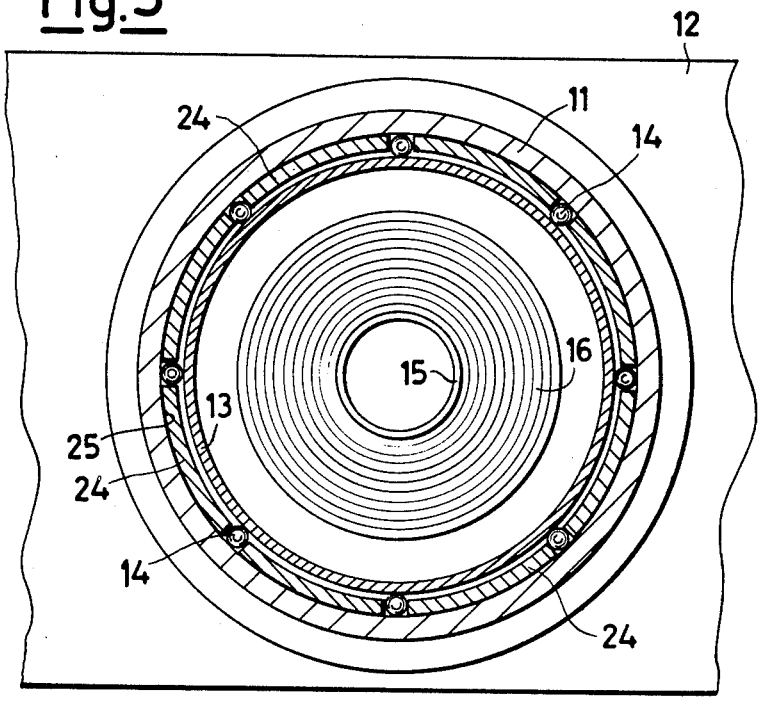
FIG. 5 is a plan cross-sectional view, taken along the line V—V of FIG. 4.

In another embodiment shown in FIGS. 4 and 5, the revolving members 14 are held properly spaced apart from each other by sectors 24 which have the shape of sectors of an annulus and which, during the operation of the machine are urged, in addition to the centrifugal force acting thereupon, by the bias of a spring 26 against the sidewall 25 of the stator 11: spring 26 is mounted pressurally in the seating 27 formed through the internal wall of the sectors 24.

Figure 6:
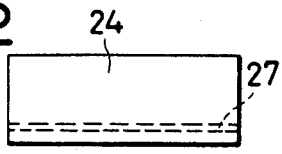
FIGS. 6 and 7 show in elevation two embodiments of sectors, in which revolving members are not incorporated.

In the example shown in FIGS. 4 and 5 there are depicted the sectors 24 shown in FIG. 6.

The operation of the rotary ring is as follows: As the machine is started, the spindles are also started and, by the agency of the tows emerging from the drawing frames, the rotors 13 are driven to rotation and when the rotor 13 is in rotary movement, it places the revolving members or balls 14 into rotation. These members 14 which roll on the sidewall 25 of the stator 11 within the bores 23 of the blocks 20 mounted on the seatings 21 formed in the annular member 22 as illustrated in FIGS. 1–3, or interposed between the sectors 24 as illustrated in FIGS. 4 and 5, consequently also place into rotation the blocks 20 and member 22 or the sectors 24. The rotation of the blocks 20 or of the sectors 24 sets up a centrifugal force acting thereon, which thrusts them towards the outside against the wall 25 of the stator 11.

The blocks 20, under the action of the centrifugal force, or the sectors 24, under the combined action of the centrifugal force and the bias of the spring 26, display a braking action, with a small specific pressure, which slightly delays the motion of the spheres 14 and thus also of the rotors 13, so as to cause the threads 17 to be wound onto the bobbins 16.

By so doing, the condition that the winding tension of the thread 17 is slightly stronger than the sum of the three frictional resistant forces due to the centrifugal forces of the rotors, the spheres and the sectors, is fulfilled.

Moreover, as the spindle speed is increased, the specific pressure is concurrently increased since the centrifugal forces due to the spin are increased, on taking into account the fact that the value of the speed of the blocks and the sectors is nearly one half the value of the spindle speed.

The sectors 24 can take special configurations, such as shown in FIGS. 7, 8, 9, 10, 12, 14, 16 and 15, that is, they can have seats such as 28 formed therein and in which the revolving members 14 are mounted with a clearance.

Such sectors can be made of a variety of materials having specific gravities from 1 to 10 kg/dm$^3$ and can be used also without the spring 26, or they can be preloaded by magnetic forces.

Figure 11:
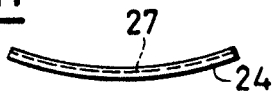
FIG. 11 shows a plan view of the sector of FIG. 6.

In FIGS. 6 and 11 there is shown, in elevation and in plan view, a sector 24 with its external walls parallel with a seating 27 to receive a spring 26. The sector 24 illustrated in FIG. 7 corresponds to that of FIG. 6, except that its external walls are tapered.

Figure 8:
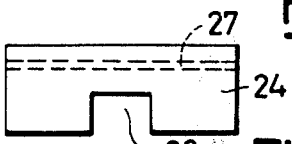
FIGS. 8, 9 and 10 show in elevation three embodiments of sectors, in which the revolving members are encased.
Figure 9:
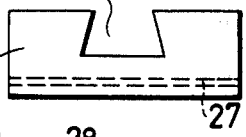
Figure 10:
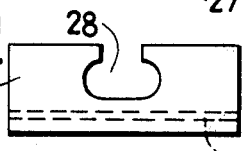

The sectors 24 shown in FIGS. 8, 9 and 10 are analogous to the one of FIG. 6, except that they each have a seat 28 adapted to receive with a clearance a revolving member 14. The seat 28 in FIG. 8 is rectangular, the one in FIG. 9 is dove-tail shaped and the one in FIG. 10 has rounded side walls.

Figure 12:
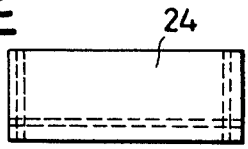
FIGS. 12 and 13 show in elevation and in plan view, respectively, another embodiment of a sector.
Figure 7:
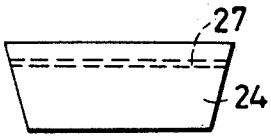
Figure 13:
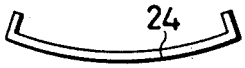

The FIGS. 12 and 13 show in elevation and in plan view a sector 24 with extremities bent back at 90°.

Figure 14:
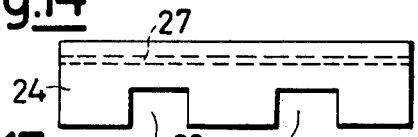
FIGS. 14, 15 and 16 show elevational views of sectors having more than one revolving member encased therein.
Figure 15:
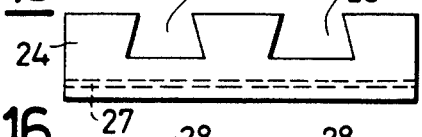
Figure 16:
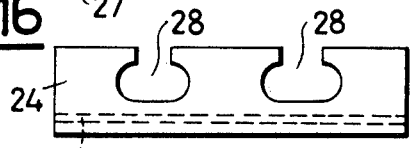
Figure 17:
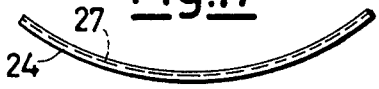
FIG. 17 is a plan view of the sector of FIG. 14.

The FIGS. 14, 15 and 16 illustrate sectors 24 similar to those shown in the FIGS. 8, 9 and 10, except that they have two seats 28 instead of only one. The sector 24 as per the FIG. 14 is shown in plan view in FIG. 17.

Figure 18:
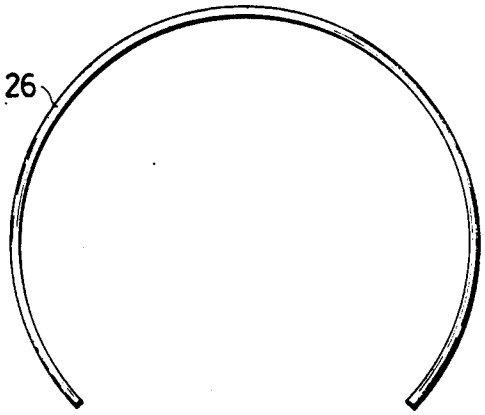
FIG. 18 shows a plan view of a spring to be incorporated in the sectors.

FIG. 18 shows, in extended plan view, a spring 26 adapted to be inserted into the seatings 27 of the sectors 24.

Within the scope of this invention, an integral annular cage is contemplated, which is made of a material which can be deformed by the action of an evenly distributed force.

Figure 20:
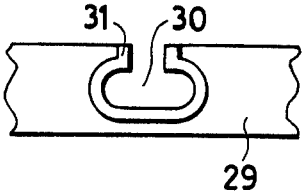
FIG. 20 is an elevational view of a detail of the seatings of FIG. 19.
Figure 19:
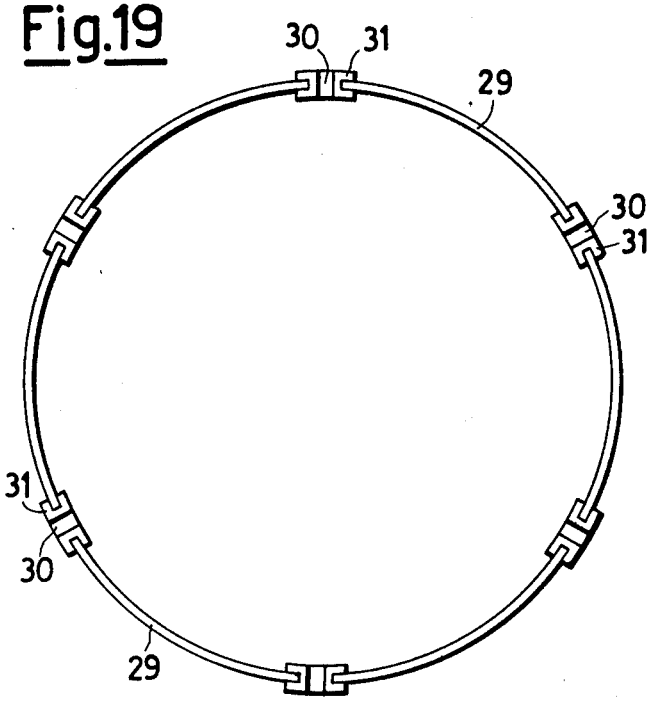
FIG. 19 is a plan view of an annular cage composed by a material which can be deformed under the action of evenly distributed forces, the seating of this cage intended to house the revolving members being composed by antifriction material insets.

FIGS. 19 and 20 show an integral annular cage composed by a material 29, which can be deformed under the action of an evenly distributed force, such as spring steel, and in which the seats 30 for housing the revolving members 14, are lined by insets 31 of an antifriction material, sold under trademarks such as Rexilon, Teflon and the like: these latter, subjected to the centrifugal force, abut the wall 25 of the stator 11 and display the braking force necessary for winding the thread 17 onto the bobbin 16.

I claim:

1. A rotary ring for spinning and twisting frames with spindles receiving thread thereon, comprising ring tails on the spinning and twisting frames, an annular stator fastened to each of said ring rails, an annular rotor rotatably mounted coaxially within said stator and with the spindle, revolving members mounted between said rotor and said stator, a hook fitted on said rotor for passing the thread therethrough when being processed, the thread driving said hook to rotation, and braking means inserted between said stator and said rotor, characterized in that said rotor is driven in rotary movement, placing said revolving members in rotation by contact therewith, said braking means consequently rotating with said revolving members by contact therewith, said braking means rotating about said rotor and under the action of the centrifugal forces thus acting thereon, frictionally engaging the internal walls of said stator thus slightly delaying the speed of said rotor relative to the spin of the spindle.

2. The rotary ring according to claim 1, wherein said braking means includes arcuate blocks of an antifriction material, an annular member resting against a bottom wall of said stator, seatings formed in said annular member with said arcuate blocks mounted with a clearance in said seatings, said annular member having the function of a spacer between said revolving members.

3. The rotary ring according to claim 2, wherein said arcuate blocks have seats to house, with a clearance, said revolving members.

4. The rotary ring according to claim 1, wherein said braking means are sectors of an annulus of an antifriction material and themselves act as spacers between said revolving members.

5. The rotary ring according to claim 4, wherein said sectors have seats to house, with a clearance, said revolving members.

6. The rotary ring according to claim 4 or 5, wherein said sectors have a horizontal groove throughout their length, and a split resilient annular body fits snugly within said horizontal groove.

7. The rotary ring according to claim 1, wherein said braking means includes a solid annular body made of a deformable material, insets in which said revolving members are housed with clearance, said insets being mounted in said solid annular body.

* * * * *